US005881646A

United States Patent [19]

Nagata et al.

[11] Patent Number: 5,881,646

[45] **Date of Patent: *Mar. 16, 1999**

[54] METHOD AND APPARATUS FOR IMAGE RECORDING BY EMITTING EVAPORATED INK ONTO A RECORDING MEDIUM

[75] Inventors: Masaya Nagata; Masayoshi Tsunezawa; Masaaki Ozaki, all of Nara; Kaoru Higuchi, Tenri, all of Japan

[73] Assignee: Sharp Kabushiki Kaisha, Osaka, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 912,097

[22] Filed: Aug. 15, 1997

[30] Foreign Application Priority Data

Aug. 21, 1996 [JP] Japan ..... 8-219509

[51] Int. Cl.[6] ..... B41F 23/04

[52] U.S. Cl. ..... 101/487; 347/89

[58] Field of Search ..... 101/364, 366, 101/487; 400/202; 347/7, 73, 74, 88, 89, 90

[56] References Cited

U.S. PATENT DOCUMENTS

| | | | |
|---|---|---|---|
| 4,403,227 | 9/1983 | Bertschy et al. | 346/75 |
| 5,341,162 | 8/1994 | Hermanson et al. | 347/89 |
| 5,438,923 | 8/1995 | Schoeps | 101/366 |

FOREIGN PATENT DOCUMENTS

| | | | |
|---|---|---|---|
| 4101695 | 8/1992 | Germany | 347/89 |
| 56-2020 B2 | 3/1977 | Japan . | |
| 56-95475 | 6/1982 | Japan | 347/89 |
| 3-51134 A | 3/1991 | Japan . | |
| 7-89108 A | 4/1995 | Japan . | |

OTHER PUBLICATIONS

IBM technical disclosure bulletin, vol. 25, No. 3A, "Evaporation Recovery System" Driscoll et al., Aug. 1982.

*Primary Examiner*—Ren Yan

*Attorney, Agent, or Firm*—David G. Conlin; David D. Lowry

[57] ABSTRACT

A second heating device heats an inner wall of an ink chamber of a print head to a temperature not lower than the melting point but not higher than evaporating temperature of ink 3, for a prescribed time period after the end of printing, based on a signal from a second heating control device. Consequently, the ink solidified and deposited on the inner wall of ink chamber and not used for printing is liquefied and recovered to the ink chamber to be used for the next printing.

15 Claims, 14 Drawing Sheets

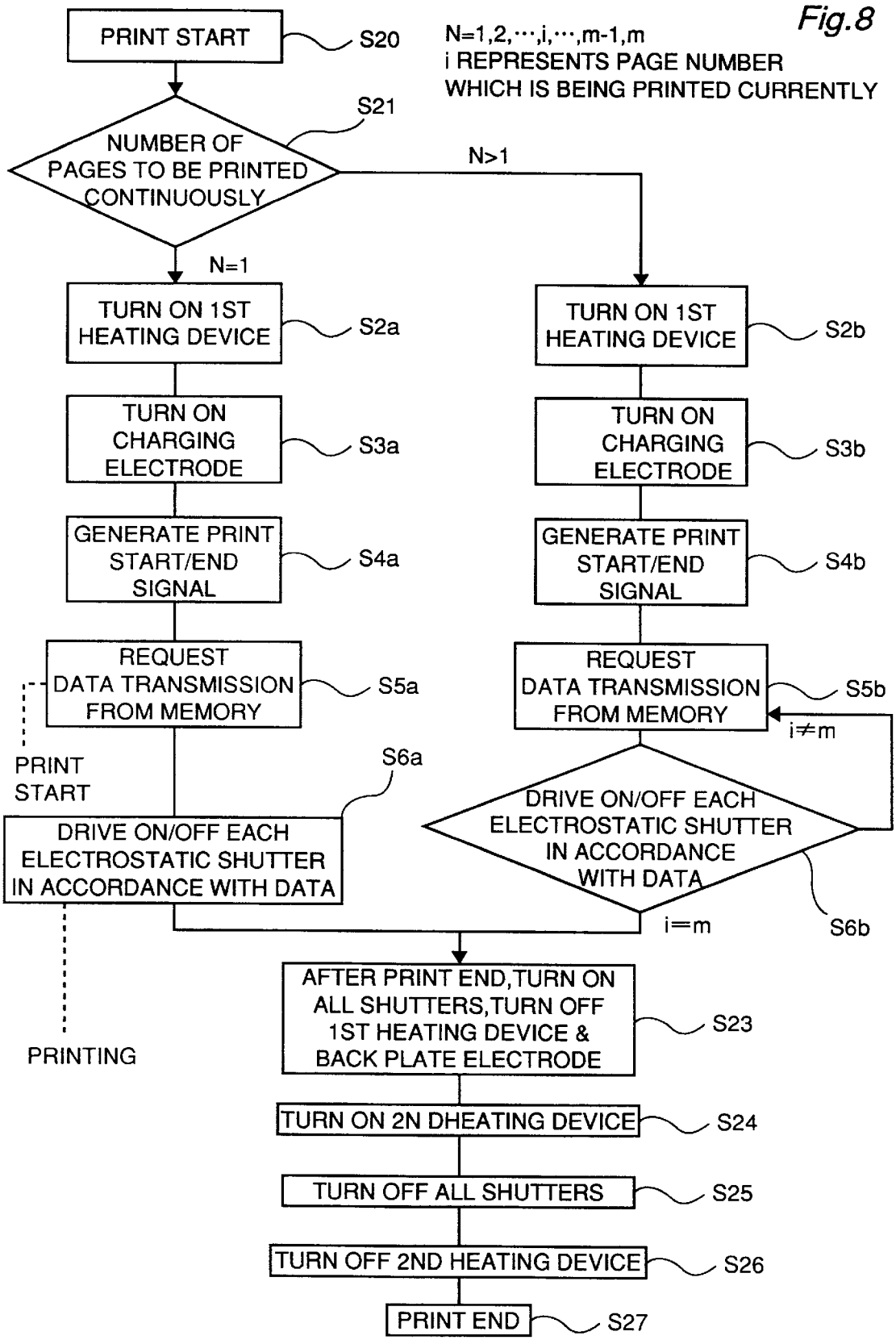
Fig.8
PRINT START
S20
N=1,2,···,i,···,m-1,m
i REPRESENTS PAGE NUMBER
WHICH IS BEING PRINTED CURRENTLY
S21
NUMBER OF PAGES TO BE PRINTED CONTINUOUSLY
N>1
N=1
TURN ON 1ST HEATING DEVICE
S2a
TURN ON 1ST HEATING DEVICE
S2b
TURN ON CHARGING ELECTRODE
S3a
TURN ON CHARGING ELECTRODE
S3b
GENERATE PRINT START/END SIGNAL
S4a
GENERATE PRINT START/END SIGNAL
S4b
REQUEST DATA TRANSMISSION FROM MEMORY
S5a
REQUEST DATA TRANSMISSION FROM MEMORY
S5b
i≠m
PRINT START
S6a
DRIVE ON/OFF EACH ELECTROSTATIC SHUTTER IN ACCORDANCE WITH DATA
DRIVE ON/OFF EACH ELECTROSTATIC SHUTTER IN ACCORDANCE WITH DATA
i=m
S6b
PRINTING
AFTER PRINT END,TURN ON ALL SHUTTERS,TURN OFF 1ST HEATING DEVICE & BACK PLATE ELECTRODE
S23
TURN ON 2N DHEATING DEVICE
S24
TURN OFF ALL SHUTTERS
S25
TURN OFF 2ND HEATING DEVICE
S26
PRINT END
S27

METHOD AND APPARATUS FOR IMAGE RECORDING BY EMITTING EVAPORATED INK ONTO A RECORDING MEDIUM

BACKGROUND OF THE INVENTION

1. Field of the Invention

The present invention relates to a method and apparatus for image recording such as a copying machine, a facsimile and a printer. More specifically, the present invention relates to a method and apparatus for recording a prescribed image by emitting evaporated ink onto a recording medium.

2. Description of the Background Art

Conventional emitting type image recording apparatuses include ones employing ink jet method and ones employing electrostatic recording method. In the ink jet method, a liquid ink contained in a tank is pressurized by using a piezoelectric element or the like by an electric signal corresponding to image data, and the pressurized ink is emitted from a nozzle for printing. In the electrostatic recording method, powder or liquid (mist) ink is charged, the ink is drawn out from the nozzle by electrostatic attraction, and printing is done by opening/closing a shutter provided at a tip end of the nozzle by an electric signal corresponding to the image data. However, in the ink jet method, when air enters the ink tank, it becomes impossible to sufficiently pressurize the ink, so that printing fails. Further, this method suffers from clogging of the nozzle with ink and inferior image quality caused by bleeding of the ink on the recording medium, since liquid ink is used. The electrostatic recording method suffers from the problem of nozzle clogging when the ink is in the form of powder as the ink particles are caked by blocking. If the ink is liquid ink, this method also suffers from the problems of nozzle clogging and ink bleeding as in the ink jet method.

A method in which gaseous ink is emitted and adhere on a recording medium has been proposed as a method of solving the above described problems. In this method, nozzle clogging is less likely, since what is emitted is a gas. Further, since pixels are recorded by molecules, printing with higher resolution, high gradient and less ink bleeding is possible. This method is disclosed in Japanese Patent Publication No. 56-2020. The conventional image recording apparatus will be described in detail with reference to FIG. 14, which is a block diagram showing the structure of the conventional ink recording apparatus.

Referring to FIG. 14, the image recording apparatus includes a print head 101, a heating device 102, a charging electrode 103, electrostatic lenses 104, 105, an electrostatic shutter 106, a back plate 107, a power source 110 and a signal source 111. The heating device 102 includes a power source 108 and an electric heater 109.

Ink I1 in print head 1 is heated and evaporated by heating device 102 including electric heater 109 and power source 108. The evaporated gaseous ink Ig is shoot forth from print head 1. Gaseous ink Ig is charged by power source 110 inserted between charging electrode 103 and print head 101 when it passes through charging electrode 103 as it is shoot out. The charged gaseous ink Ig is focused by electrostatic lenses 104 and 105. Thereafter, the amount of emission of the focused gaseous ink Ig is controlled to be a prescribed amount, by electrostatic shutter 106 of which operation is controlled by signal source 111. The ink of which amount is thus controlled travels to back plate electrode 11, whereby an image is formed on a recording medium RM.

However, in the conventional image recording apparatus, the gaseous ink Ig is emitted continuously from print head 101, and the ink not actually used for recording is wasted, increasing running cost.

SUMMARY OF THE INVENTION

An object of the present invention is to provide a method and an apparatus for image recording which effectively utilizes ink, enabling reduction in running cost.

The above described object can be attained by the image recording apparatus in accordance with the present invention in which image is recorded by emitting ink contained in advance in a reservoir portion onto a recording medium. The apparatus includes a first heating portion for evaporating ink by heating; an emitting portion for emitting the ink evaporated by the first heating portion from the reservoir portion to the recording medium; a control portion for controlling the gaseous ink such that the gaseous ink is intermittently emitted through the emitting portion in accordance with image data corresponding to the image; and a second heating portion for heating and liquefying ink which is solidified and adhered on an inner wall of the reservoir portion.

Accordingly, the ink solidified and adhered on the inner wall of the reservoir portion is liquefied by the second heating portion, and recovered in the reservoir portion to be used again for image recording. Therefore, the ink can be effectively utilized and the running cost can be reduced.

The image recording apparatus further includes a heating control portion for operating the second heating portion before or after image recording. Therefore, the ink solidified and adhered on the inner wall of the reservoir portion can be liquefied before or after image recording, surely preventing deposition of ink on the inner wall of the reservoir portion, thus effectively using the ink.

The heating control portion mentioned above is adapted, when images are to be continuously recorded on a plurality of recording media, respectively, to operate the second heating portion before or after continues recording. Therefore, even when images are to be recorded continuously on a plurality of recording media, respectively, deposition of ink on the inner wall of the reservoir portion can be prevented, and the ink is well utilized.

The temperature of heating the ink adhered on the inner wall by the second heating portion mentioned above is set lower than the evaporating temperature of the ink. Therefore, evaporation of the ink adhered on the inner wall surface of the reservoir portion is suppressed, and hence leakage of the ink caused by increase of inner pressure of the reservoir portion by evaporation can also be prevented.

The image recording apparatus further includes an emission control portion for suppressing emission of the gaseous ink from the reservoir portion while the second heating portion is in operation. Therefore, while the second heating portion is in operation, leakage of the ink from the reservoir portion can be suppressed.

The time of operation for heating the ink adhered on the inner wall surface of the reservoir portion by the second heating portion mentioned above is determined in accordance with the amount of ink adhered on the inner wall. Therefore, the ink adhered on the inner wall surface can be recovered without wasting the amount of operation of the second heating portion.

The inner wall of the reservoir portion mentioned above has such a shape that facilitates recovery of the ink which is liquefied by heating by the second heating portion, to the reservoir portion. Therefore, the ink on the inner wall surface of the reservoir portion and liquefied by the second heating portion can readily be recovered to the reservoir portion.

The above described object can be attained by the method of image recording in accordance with the present invention for recording an image by emitting ink contained in advance in a reservoir portion to a recording medium, which method includes a first step of intermittently emitting evaporated ink from a reservoir portion to the recording medium in accordance with image data corresponding to an image at the time of recording, and a second step of liquefying ink adhered, by the image recording, on the inner wall of the reservoir portion.

Accordingly, the ink adhered on the inner wall of the reservoir portion at the time of recording can be liquefied and recovered to the reservoir portion. Accordingly, the ink is effectively utilized and the running cost can be reduced.

The second step includes a third step of suppressing emission of the evaporated ink from the reservoir portion, and a fourth step of heating ink adhered on the inner wall of the reservoir portion. Accordingly, the ink adhered on the inner wall of the reservoir portion can be recovered while suppressing leakage of ink from the reservoir portion, and thus the ink can be effectively utilized.

The foregoing and other objects, features, aspects and advantages of the present invention will become more apparent from the following detailed description of the present invention when taken in conjunction with the accompanying drawings.

BRIEF DESCRIPTION OF THE DRAWINGS

FIG. 8 is a first flow chart showing operation including determination as to whether continues printing is to be performed, of the image recording apparatus shown in FIG. 1.

DESCRIPTION OF THE PREFERRED EMBODIMENTS

An embodiment of the present invention will be described with reference to the drawings.

Figure 1:
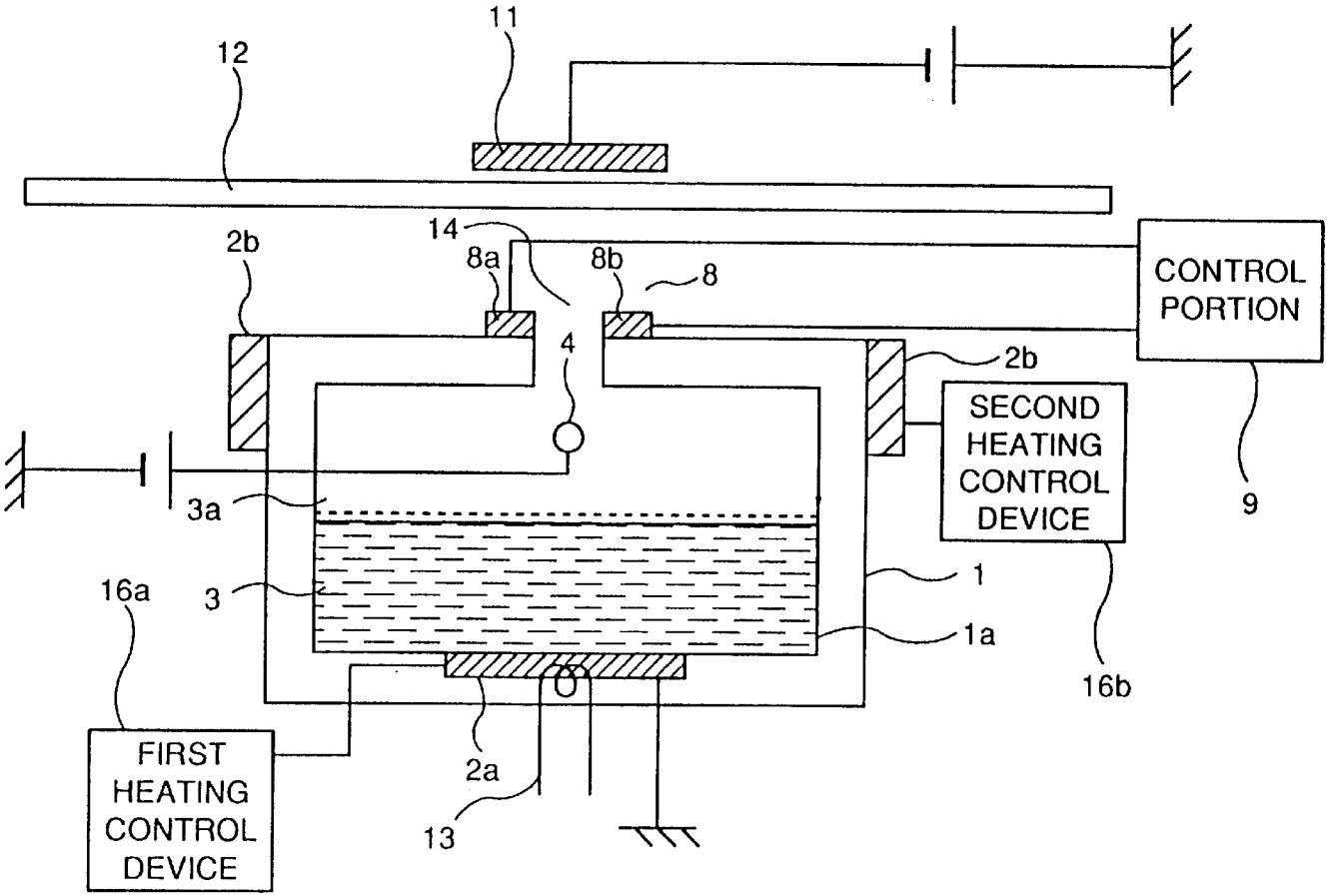
FIG. 1 shows an image recording apparatus in accordance with one embodiment of the present invention.

FIG. 1 shows a structure of the image recording apparatus in accordance with one embodiment of the present invention. The apparatus shown in FIG. 1 intermittently emits a gas which is an evaporated ink, in accordance with an electric signal corresponding to an image data to be recorded, with thus emitted ink being adhered or infiltrated with the recording medium to provide an image. The image recording apparatus includes a heating device for heating the ink, an emitting device for emitting the heated and evaporated ink, and an emission control device for controlling emission such that the evaporated ink is intermittently emitted in accordance with electric signals corresponding to the image data to be recorded. The emitting device includes a charging electrode portion for charging the evaporated ink, and a back plate electrode portion arranged behind the recording medium for guiding the charged gaseous ink onto the recording medium. The emission control device includes a shutter portion for physically or electrically controlling emission of the ink, and a control portion responsive to an input of an electric signal corresponding to the image data for outputting a corresponding signal to control the shutter portion. The heating device, the charging electrode portion and the shutter portion are integrated to provide a print head.

The image recording apparatus will be described with reference to FIG. 1. Referring to FIG. 1, the image recording apparatus includes a print head 1, heating devices 2*a* and 2*b* controlled by heating control devices 16*a* and 16*b*, a back plate electrode 11 provided behind a recording medium 12, and a control portion 9. In print head 1, an ink chamber 1*a* is provided, in which solid or liquid ink 3 is reserved. Print head 1 includes heating devices 2*a* and 2*b* including an electric heater 13 and a heat radiating plate (not shown) for heating ink in ink chamber 1*a*; a charging electrode 4 formed of a thin wire electrode having the width of about 50 to about 80 $\mu$m for charging ink 3*a* in ink chamber 1*a* which was obtained by evaporating ink 3 by heating; an emission opening 14 for externally emitting ink 3*a* from print head 1 (ink chamber 1*a*); and an electrostatic shutter 8 including electrodes 8*a* and 8*b* provided at emission opening 14. Electrostatic shutter 8 has its ON (open)/OFF(close) controlled by control portion 9 and controls ink 3*a* passage through emission opening 14.

Figure 2:
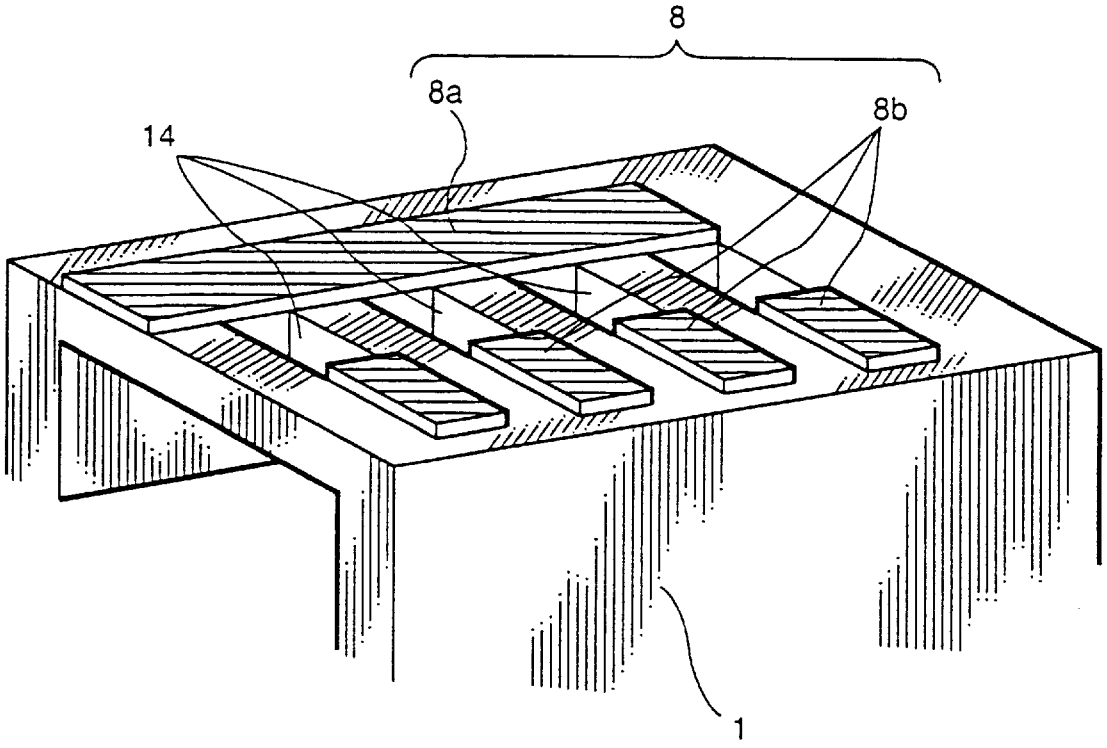
FIG. 2 is a perspective view showing an example of a structure of the emission opening shown in FIG. 1.
Figure 3:
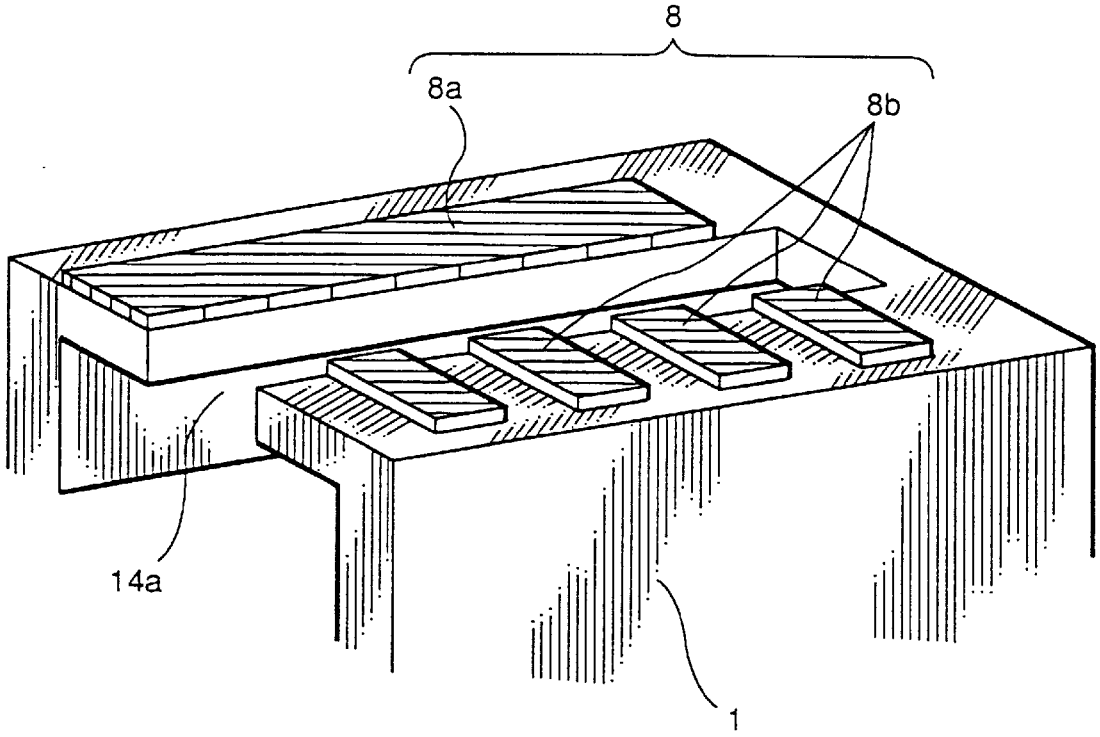
FIG. 3 is a perspective view showing another example of the structure of the emission opening shown in FIG. 1.

FIG. 2 is a perspective view showing an example of a structure of emission opening 14 shown in FIG. 1. FIG. 3 is a perspective view showing another example of the structure of emission opening 14 shown in FIG. 1. Referring to FIG. 2, on an upper portion of print head 1, a plurality of emission openings 14 are formed over a length which corresponds to the width of printing. The space between each of the plurality of emission openings 14 is set to 169 $\mu$m, assuming that the recording density is 150 dpi. The emission opening 14 may be a slit 14*a* as shown in FIG. 3, with electrostatic shutter 8 including electrodes 8*a* and 8*b* provided on both sides of the longer side of slit 14*a*. The length L of slit 14*a* corresponds to the printing width in a line head, which is about 200 mm for an A4 size sheet, about 140 mm for an A5 size sheet. The width W of slit 14*a* is 200 $\mu$m when the recording density is 150 dpi. The slit 14*a* shown in FIG. 3 is advantageous in that clogging is less likely as compared with the emission opening 14 of FIG. 2.

In the image recording apparatus shown in FIG. 1, at the time of printing, ink 3 is heated and evaporated by heating device 2*a*. As for the dye of ink 3, when colored ink is used, substances belonging to anthoraisothiazole system, quinophthalone system, pyazolonazo system, pyridone azo system, styryl system or the like may be used for yellow. For magenta, substances belonging to anthraquinone system, dicyanoimidazole system, thiadiazoleazo system, tricyanovinyl system or the like may be used. For cyan, substances belonging to azo system, anthraquinone system, napthoquinone system, indoaniline system or the like may be used.

When ink 3 is evaporated to be gaseous ink 3*a* and a voltage of about +1 to about 5 kV is applied to the charging electrode, corona discharge occurs in the direction of the grounded heating device 2*a* so that the gaseous ink 3*a* is charged to have +ions. Thereafter, when a voltage of about −0.5 to (about) −2 kV, for example, −1 kV is applied to the back plate electrode 11 provided behind the printing surface of recording medium 12, the charged gaseous ink 3*a* is guided to the direction of recording medium 12. Here, electrostatic shutter 8 controls emission of ink 3*a* in accordance with the signals corresponding to the image data output from control portions 9, and hence an image corresponding to the image data is formed on the printing surface of recording medium 12.

The operation of electrostatic shutter 8 will be described, taking the example of FIG. 3 in which emission opening 14 of FIG. 1 is a slit 14*a*. The electrostatic shutter 8 of FIG. 3 includes a common electrode 8*a* and control electrodes 8*b* provided in a comb shape with a space of 169 $\mu$m therebetween, corresponding to the recording density. Common electrode 8*a* is grounded. To the control electrodes 8*b*, an output signal from control portion 9 which corresponds to the electric signal of the image data to be recorded, in other words, a voltage of 50 V to 1 kV (high level:H), generally, or 0 V (low level:L) is applied. When the voltage of control electrode 8*b* is 500 V (H), for example, electrostatic shutter 8 is ON, and an electric field is generated from control electrode 8*b* to common electrode 8*a*. Therefore, the ink 3*a* charged with +ions cannot pass through electrostatic shutter 8. Meanwhile, when the voltage of control electrode 8*b* is 0 V (L), there is not an electric field generated between control electrode 8*b* and common electrode 8*a*. Therefore, ink 3*a* passes through electrostatic shutter 8, guided by the electric field caused by back plate electrode 11. In this case, electrostatic shutter 8 is off. In this manner, by turning ON/OFF of the voltage at control electrode 8*b*, intermittent emission of ink 3*a* can be controlled. Further, by controlling potential of electrodes corresponding to respective pixels, passage of gaseous ink 3*a* through emission opening 14 can be controlled on a per pixel basis.

In such an image recording apparatus, ink 3*a* obtained by heating ink 3 by heating device 2*a* remains in ink chamber 1*a* unless it passes through electrostatic shutter 8. At this time, when the temperature of the inner wall surface of ink chamber 1*a* is not higher than the evaporating temperature of ink 3, the gaseous ink 3*a* which is brought into contact with the inner wall surface turns to liquid, and adheres on the inner wall surface of ink chamber 1*a*. When printing is completed, power supply to heating device 2*a* is stopped and the temperature of the inner wall surface of ink chamber 1*a* attains to be lower than the melting point of ink 3, ink turns to solid ink.

The solid ink adhered on the inner wall surface of ink chamber 1*a* is not evaporated and does not contribute to printing, as the inner wall surface of ink chamber la does not reach evaporating temperature of ink 3 even when heating device 2*a* is driven at the time of next printing. Further, since solid ink is deposited gradually on the inner wall surface of ink chamber 1*a*, the amount of ink adhered on the inner wall surface of ink chamber 1*a* and wasted increases.

When ink chamber 1*a* is cooled too fast when driving of heating device 2*a* is stopped, or when the difference between ink evaporating temperature and ink melting point is too small, gaseous ink 3*a* floating in ink chamber 1*a* is immediately cooled and solidified, so that there would be a web of solidified ink in ink chamber 1*a*. In this state, even when heating device 2*a* is driven for printing the next time, the solid ink in the form of a web is not heated and therefore it cannot be used for printing. Therefore, considerable amount of ink is wasted, and in addition, gaseous ink tends to be adhered on web, promoting solidification of the ink. Further, when this phenomenon occurs at the emission opening 14 (14*a*), it causes clogging, leading to failure of ink emission.

It may be possible as means to prevent the above described phenomenon, to form the inner wall of ink chamber 1*a* by a material having superior thermal conductivity and to drive heating device 2*a* such that the inner wall of ink chamber 1*a* attains to the ink liquefying temperature, so as to prevent solidifying of ink. However, when ink chamber 1*a* as a whole is kept at a high temperature, gaseous ink 3*a* which is in a high pressure state may be emitted, which is not preferable. Further, there is inevitably a temperature difference between the ink heating portion and the inner wall of ink chamber 1*a*. Therefore, when the actual ink heating temperature is set exceeding the ink liquefying temperature, the ink heating temperature may be too high, and possibly thermally damages the ink. Therefore, the ink heating temperature is limited to the temperature which can avoid thermal damage to the ink. Therefore, dependent on the type of ink used, the temperature of the inner wall surface of ink chamber 1*a* cannot be increased to the liquefying temperature. Therefore, this approach is not preferable.

In order to prevent gaseous ink 3*a* from being solidified on the inner wall of ink chamber 1*a*, driving of the second heating device 2*b* is controlled by the second heating control device 16*b*. The second heating device 2*b* have only to be attached such that it can heat the temperature of the inner wall surface of ink chamber 1*a* at least near the emission opening 14 so that the temperature thereof is not lower than the melting point but not higher than the liquefying temperature of ink 3. The position of attachment is not specifically limited.

Figure 4:
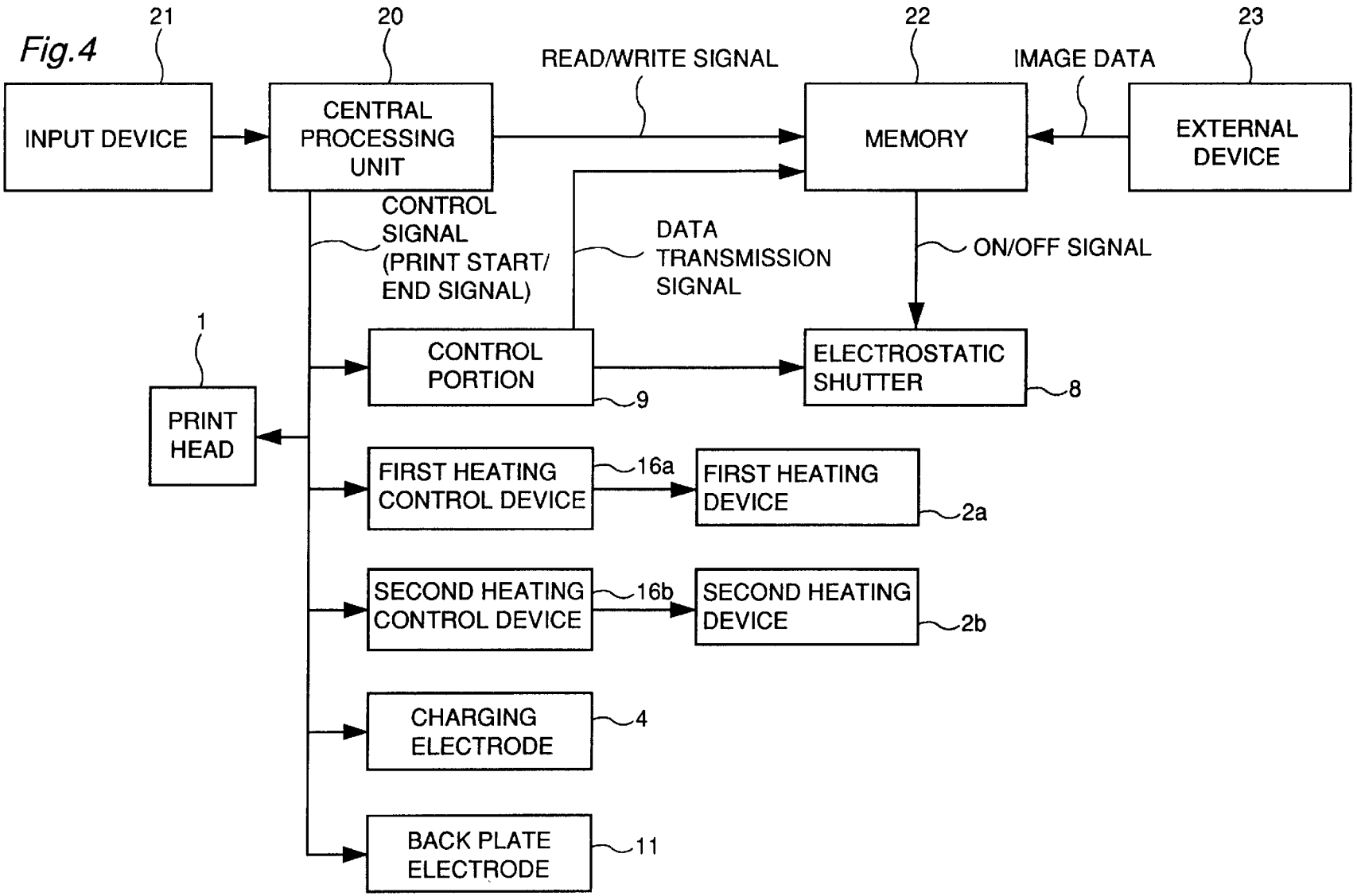
FIG. 4 is a block diagram showing control of the image recording apparatus of FIG. 1.
Figure 5:
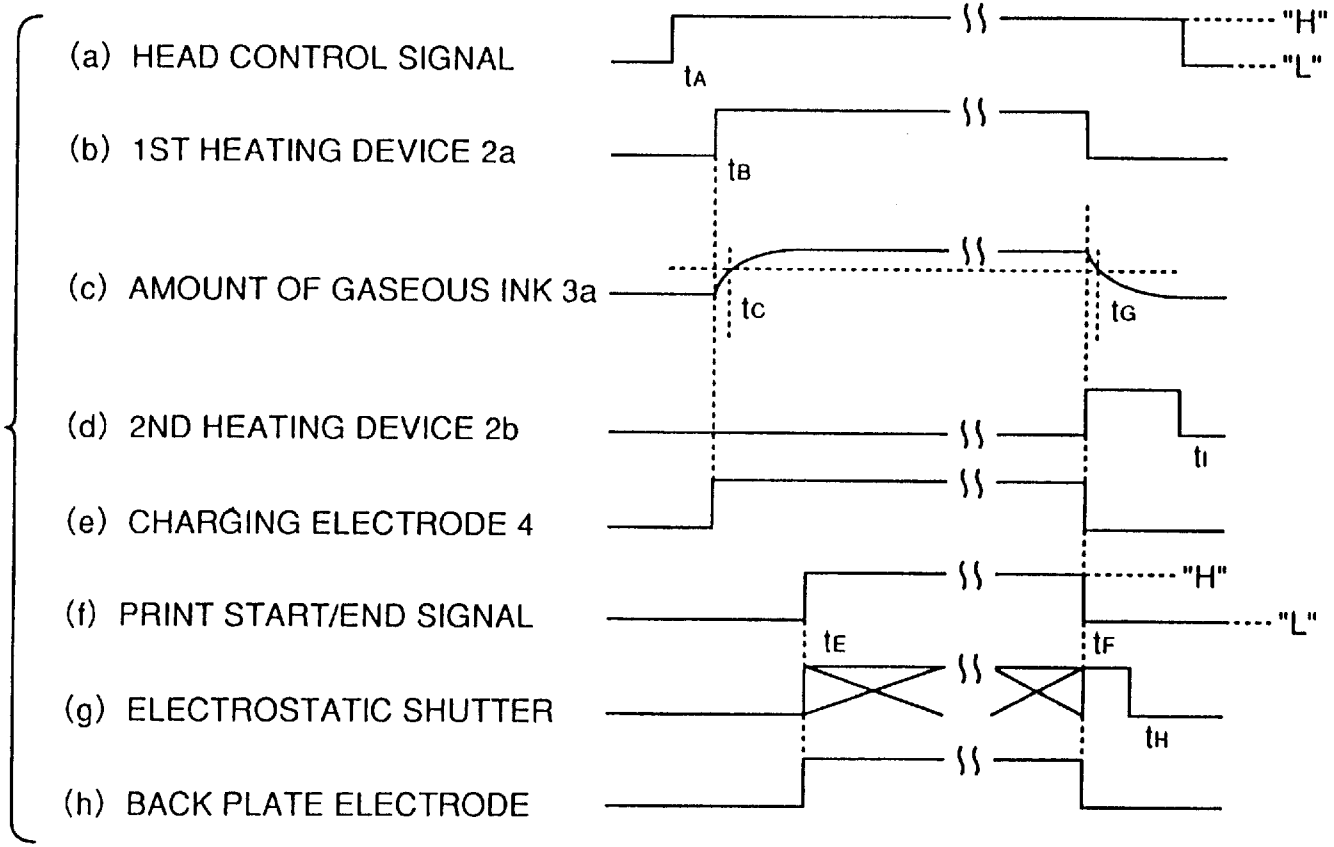
FIG. 5 is a timing chart showing the operation of the image recording apparatus of FIG. 1.
Figure 6:
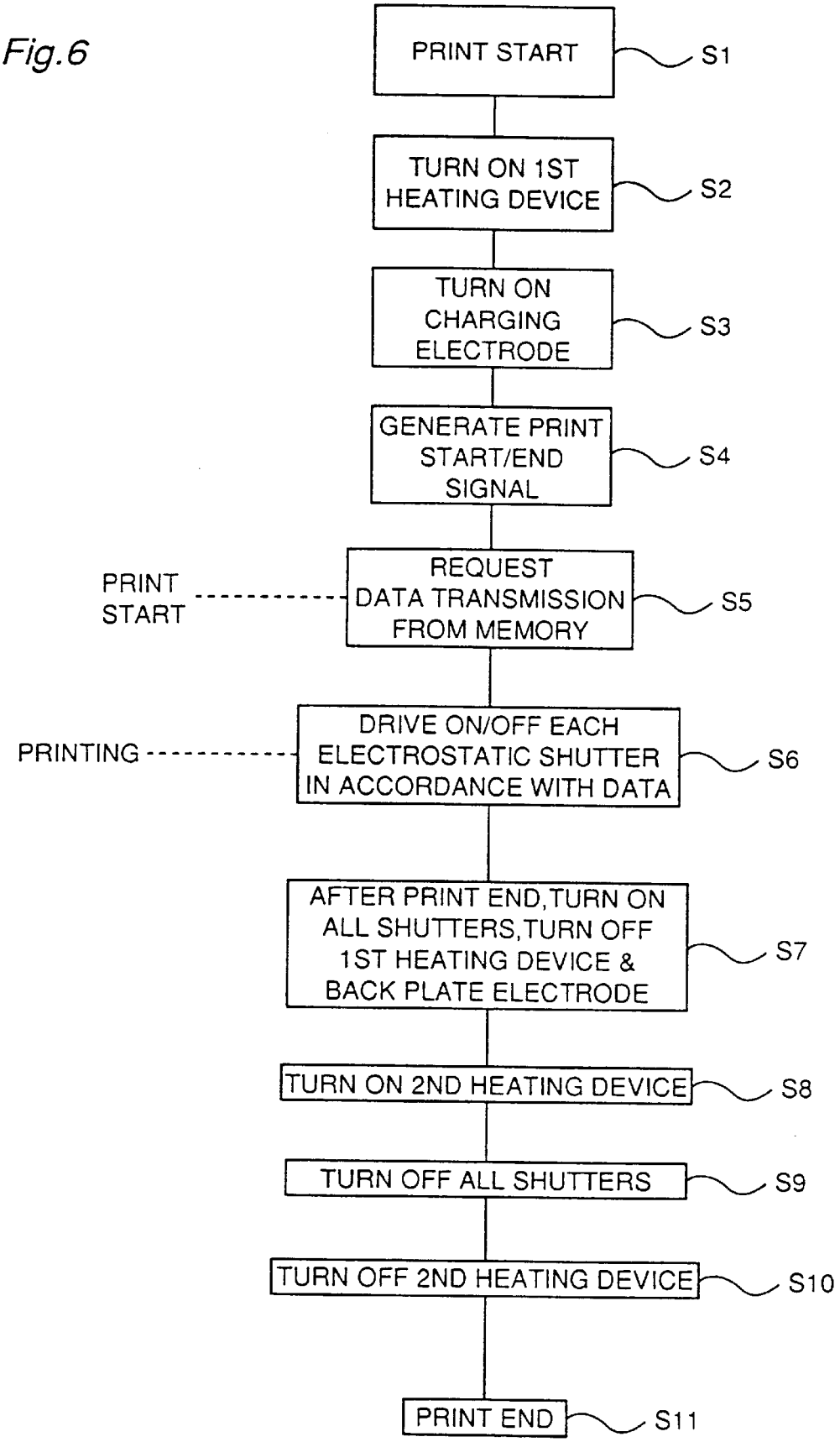
FIG. 6 is a flow chart related to the operation of the image recording apparatus shown in FIG. 1.

FIG. 4 is a block diagram for controlling the image recording apparatus shown in FIG. 1. FIGS. 5 and 6 are a timing chart and a flow chart showing the operation of the image recording apparatus shown in FIG. 1, respectively.

Figure 7:
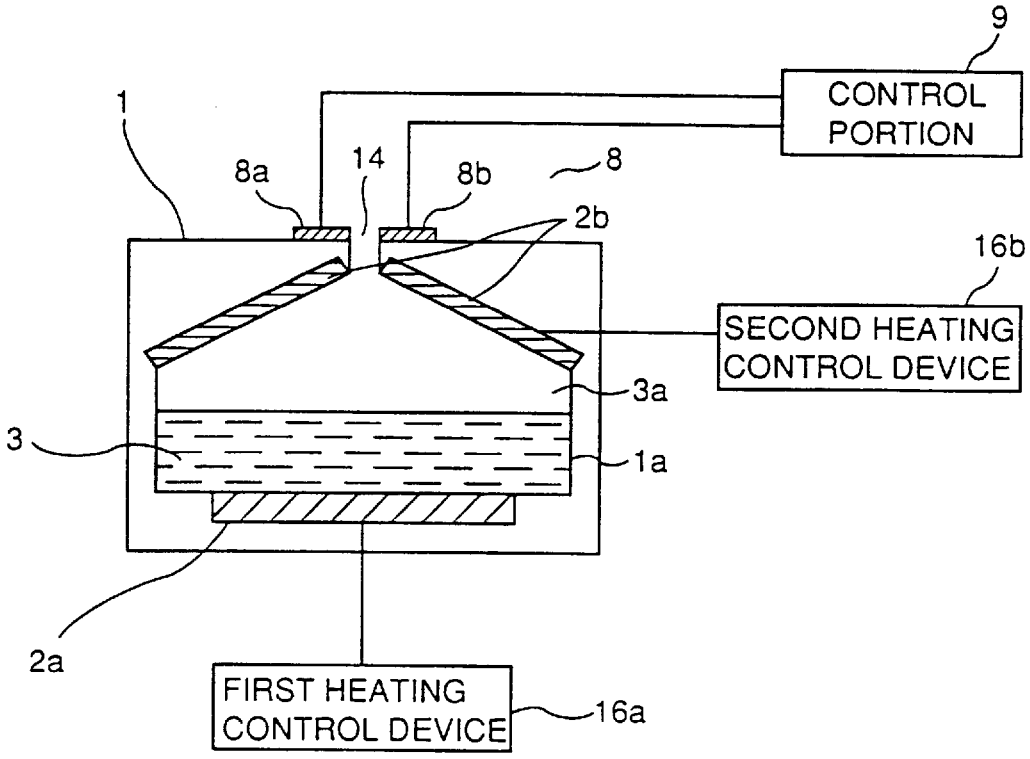
FIG. 7 shows a modification of the inner wall shape of an ink chamber shown in FIG. 1.

FIG. 7 shows one modification of the shape of the inner wall of ink chamber 1*a* shown in FIG. 1.

Referring to FIG. 4, the image recording apparatus of FIG. 1 includes a central processing unit (CPU) 20 for centralized control of the apparatus itself to enable image recording operations of various portions shown in FIG. 1; an input device 21 which is externally operated for providing various signals such as instruction and control for processing to CPU 20; a memory 22 in which various data such as image data to be recorded as well as control program are stored in advance; and an external device 23 for externally transferring and writing image data to memory 22. CPU 20 accesses memory 22 in accordance with a read/write signal, and controls by various control signals print head 1, control portion 9, heating control devices 16*a* and 16*b*, charging electrode 4 and back plate electrode 11, which have been described with reference to FIG. 1. Control portion 9 applies an image data transmission signal to memory 22 so that image data is output as ON/OFF signal from memory 22 to electrostatic shutter 8. Control portion 9 controls electrostatic shutter 8 by using ON/OFF signal from memory 22.

The operation of the image recording apparatus shown in FIG. 1 including heating by the heating device 2*b* will be described with reference to the charts of FIGS. 5 and 6.

First, from CPU 20, a head control signal is transmitted to print head 1 ((*a*) of FIG. 5). This signal represents inoperative state when it is at the "L" level and head operative state when it is at the "H" level, indicates print start at the timing of "rise", that is, head operation start timing, and indicates print end at the timing of the "fall", that is, the head operation end timing.

The first heating control device 16*a* drives the first heating device 2*a* at time point $t_B$ ((b) of FIG. 5, S1 and S2 of FIG. 6), using rise of the head control signal (point $t_A$ of FIG. 5) as a trigger. At this time, a voltage of +1 to 5 kV is applied to the charging electrode 4 ((e) of FIG. 5, S3 of FIG. 6), and ink 3*a* evaporated by the first heating device 2*a* is charged.

When the first heating device 2*a* is driven, ink 3 is heated and the temperature of ink 3 exceeds the liquefying temperature $T_g$, ink 3 is evaporated to gaseous ink 3*a*. As time passes, the amount of gaseous ink 3*a* in ink chamber 1*a* increases and reaches a threshold value at time $t_C$. The threshold value represents amount of gaseous ink 3*a* sufficient for emission in ink chamber 1*a*. When the amount of ink 3*a* is at the threshold value or higher, printing is possible. This state corresponds to the state of ink chamber 1*a* filled with gaseous ink 3*a* with high pressure.

First heating device 2*a* is controlled by the heating control device 16*a* to attain a certain temperature T which is not lower than the ink liquefying temperature $T_g$. More specifically, the first heating device 2*a* is controlled such that the relation $T=T_g+\Delta T$ holds. Here, $\Delta T$ is determined taking into consideration the temperature stability of the first heating device 2*a*, change in ambient temperature and so on. When the ink liquefying temperature $T_g$ is 140° C., for example, the heating device 2*a* is controlled such that T=155° C., with the value $\Delta T$ being $\Delta T$=15° C.

At a certain time point $t_E$ after printing becomes possible, a print start/end signal is output for emission control from CPU 20 to control portion 9 ((f) of FIG. 5, S4 of FIG. 6). The print start/end signal represents nonprinting state when it is "L" and print state when it is "H". The "rise" timing of this signal indicates the timing of print start, and "fall" timing of this signal indicates the print end timing.

In the present embodiment, whether the amount of gaseous ink 3*a* has exceeded the threshold value enabling printing or not is determined based on experiment, by detecting temperature $T_H$ of the print head 1 or time t after the start of driving the first heating device 2*a*. More specifically, by an experiment, when the first heating device 2*a* is driven and print head 1 is heated, the amount of generation of gaseous ink 3*a* with respect to the temperature of head 1, or the amount of generation of gaseous ink 3*a* with respect to the time after the start of heating of print head 1 is measured, to define the relation therebetween.

Measurement of the amount of generation of the gaseous ink 3*a* is performed by measuring print density by actually printing on a print sheet, for example. Based on the characteristic of the amount of generation of gaseous ink 3*a* relative to the temperature of head 1, or based on the characteristic of the amount of generation of gaseous ink 3*a* relative to the time after the start of heating of print head 1, CPU 20 calculates a temperature $T_{th}$ of head 1 or time $t_{th}$ after the start the start of heating print head 1 which ensures necessary density for printing, and uses the calculated value as a reference value for determination. By comparing values $T_H$ and t obtained as a data with the reference values, whether or not the amount of generation of gaseous ink 3*a* exceeded the threshold value or not is determined, and print start/end signal is generated.

Control portion 9 requests transfer of image data by outputting a data transmission signal to memory 22, using the rise of print start/end signal as a trigger, and when data transfer from external device 23 to memory 22 is completed, ON/OFF signal corresponding to the image data is output from memory 22 to electrostatic shutter 8 (S5 and S6 of FIG. 6). Electrostatic shutter 8 is connected to a power source, not shown, supplying a voltage of 500 V. Since the voltage of 500 V is supplied/stopped in accordance with the image data, the shutter is turned ON/OFF ((g) of FIG. 5, S6 of FIG. 6). At time $t_E$ when electrostatic shutter 8 starts its turning ON/OFF, a voltage of −1 kV is applied to the back plate electrode 11 ((h) of FIG. 5), and printing starts. During printing, print start/end signal is maintained at "H" level.

After the end of printing, at time point $t_F$, the print start/end signal falls to the L level. Using the fall as a trigger, first heating device 2*a*, charging electrode 4 and back plate electrode 11 are all turned off ((b), (e) and (h) of FIG. 5, S7 of FIG. 6).

Thereafter, when printing is not continued and head 1 is cooled naturally, ink is solidified in ink chamber 1*a*. Therefore, after the end of printing, the second heating device 2*b* is driven by second heating control device 16*b* so that the temperature of the inner wall surface of ink chamber 1*a* attains to a certain temperature not lower than the ink melting point ((d) of FIG. 5, S8 of FIG. 6). The first heating control device 16*a* drives the first heating device 2*a* such that the ink 3 attains to a temperature not lower than the evaporating temperature, the second heating control device 16*b* drives heating device 2*b* such that the temperature of the inner wall surface of ink chamber 1 is not lower than the melting point but lower than the evaporating temperature of ink 3, so as to prevent ink 3 from being evaporated to gaseous ink 3*a* and emitted from emission opening 14. At this time, the time period of driving the second heating device 2*b* may be several tens of seconds to several minutes in accordance with the amount of ink adhered on the inner wall of ink chamber 1*a*. When the heating device 2*b* is driven at the end of every printing operation, the driving time period per one operation can be made short. If the device is driven once in several printing operations, the time period should be made longer. Thereafter, the driving of the second heating device 2*b* is stopped, and printing ends ((a) and (d) of FIG. 5, S10 and S11 of FIG. 6).

Since rapid solidification of gaseous ink 3*a* on the inner wall surface of ink chamber 1*a* after the end of printing can be prevented by the second heating device 2*b*, the space in ink chamber 1*a* does not have the web of solidified ink 3 mentioned above. Further, by adapting the shape of the inner wall of ink chamber 1*a* such that the upper side surface of ink chamber 1*a* is inclined as shown in FIG. 7, the ink which is liquefied on the inner wall surface can be recovered as ink 3 to the ink containing portion at the bottom of ink chamber 1*a*, and therefore ink will not be deposited on the inner wall of ink chamber 1*a*.

Even when power supply by the first heating control device 16*a* to the first heating device 2*a* is stopped, the gaseous ink 3*a* which has been evaporated and remaining in ink chamber 1*a* is not cooled immediately. Therefore, after the end of printing, electrostatic shutter 8 is forced ON by control portion 9, so as to prevent leakage from ink 3*a* from emission opening 14 ((g) of FIG. 5, S7 of FIG. 6). The period in which the shutter is forced ON may be terminated after the time point $t_G$ when the amount of gaseous ink 3*a* becomes lower than the threshold value, and the period may be determined taking into consideration operation margin or the like (point $t_H$ of FIG. 5). After the time point $t_H$, until the start of next printing operation, the electrostatic shutter 8 may be kept OFF (S9 of FIG. 6).

Here, the second heating device 2*b* is driven after the end of printing. However, it may be driven before the start of printing.

When printing is to be continued over a plurality of recording media 12 by the image recording apparatus of the present embodiment, the second heating device 2*b* may be driven after the end of printing or before the start of printing of the plurality of recording media 12. In that case, whether or not printing is to be done over a plurality of recording media 12 or not is determined based on an externally input signal through an input device 21, by the CPU 20, or it may be determined based on whether another recording medium 12 is supplied for printing within a prescribed time period after printing of one recording medium 12.

Figure 9:
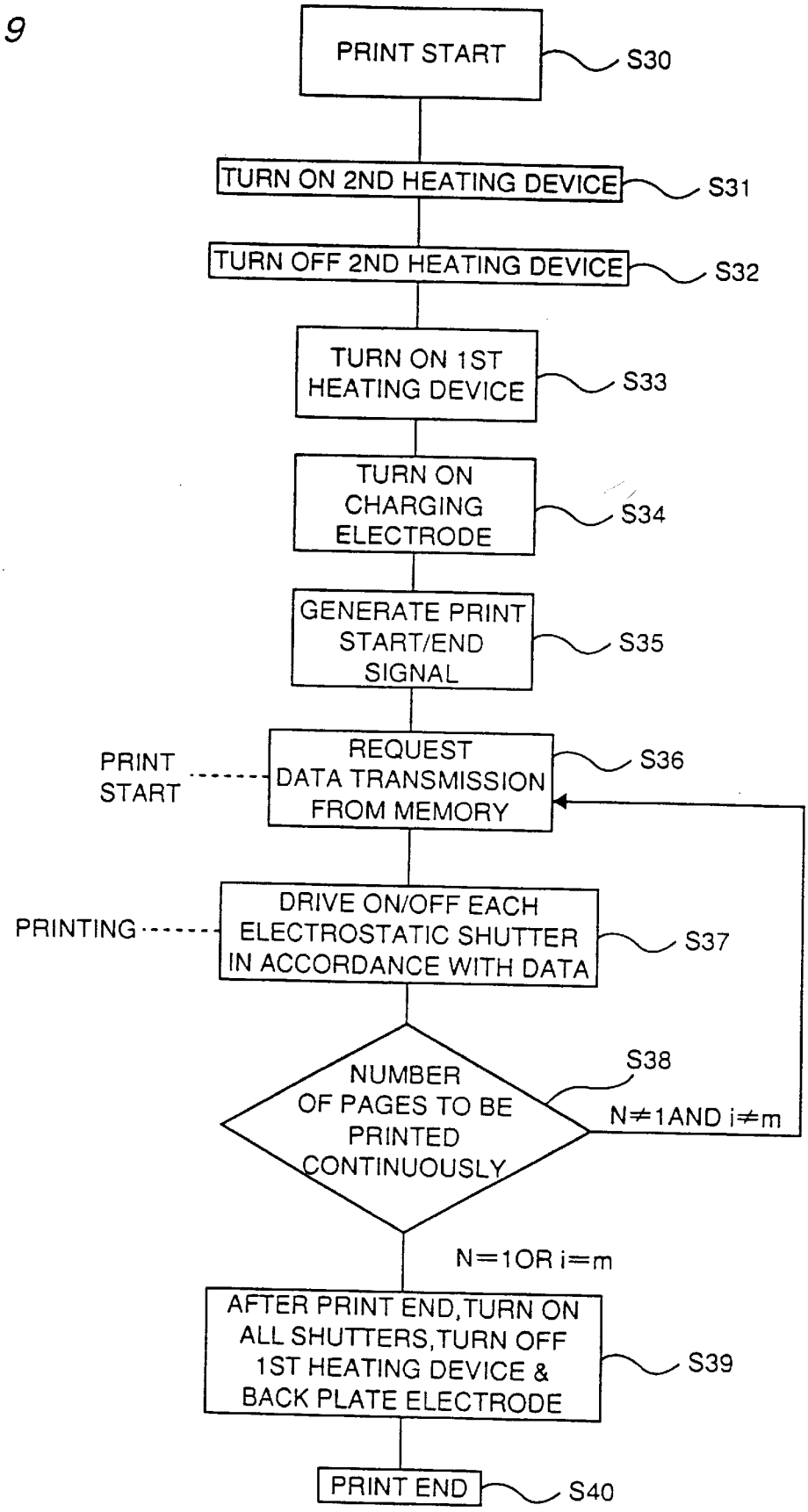
FIG. 9 is a second flow chart showing the operation including determination as to whether continues printing is to be performed, of the image recording apparatus shown in FIG. 1.
Figure 10:
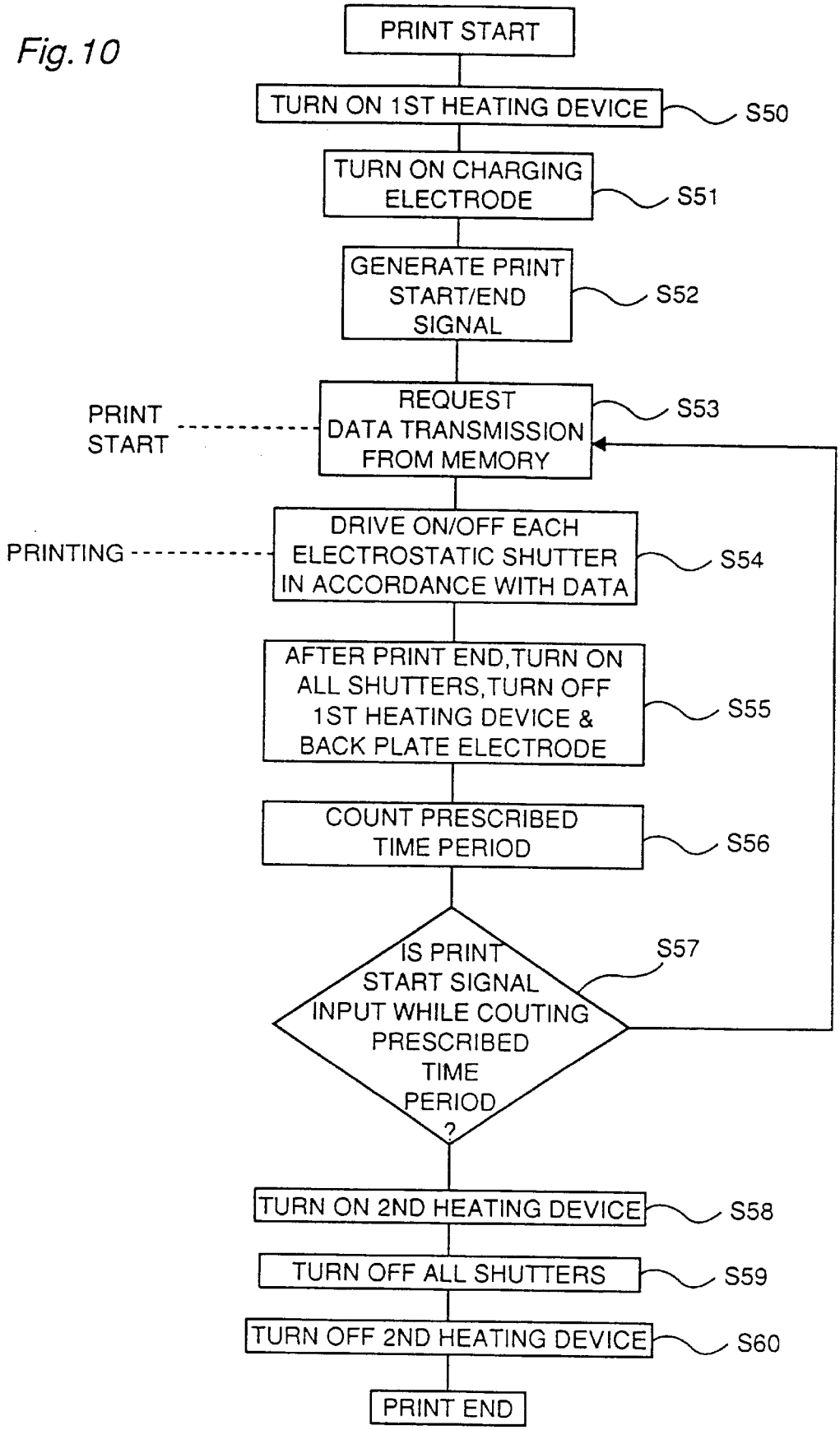
FIG. 10 is a third flow chart showing the operation including determination as to whether continuous printing is to be performed, of the image recording apparatus shown in FIG. 1.

FIGS. 8, 9 and 10 are first, second and third flow charts showing the operation including determination as to whether it is continuous printing, of the image recording apparatus shown in FIG. 1. In the flow chart of FIG. 8, when printing starts (S20 of FIG. 8), CPU 20 determines the number N of the recording media on which printing is to be continued based on an input signal from an input device 21 (S21 of FIG. 8). At this time, when N=1, printing operation for one recording medium 12 is performed in the similar manner as shown in FIG. 6 (S2*a* to S6*a* of FIG. 8). Thereafter, in the similar manner as shown in FIG. 6, operation for heating using the second heating device 2*b* is performed (S23 to S27 of FIG. 8). Meanwhile, when N>1 and it is determined that printing should be performed over m recording media 12, printing operation is repeated m times (S2*b* to S6*b* of FIG. 8). Thereafter, in the similar manner as shown in FIG. 6, operation related to heating using the second heating device is performed (S23 to S27 of FIG. 8).

In the second flow chart of FIG. 9, the number N of the recording media 12 over which printing is continued is determined, while the operation related to heating using the second heating device 2*b* described above (S8 to S10 of FIG. 6) is performed prior to the start of printing operation (S31 and S32 of FIG. 9).

In the third flow chart of FIG. 10, it is determined whether a next recording medium 12 is to be fed to the apparatus for printing within a prescribed time period, after the end of printing on one recording medium 12. Since the flow chart of FIG. 10 is similar to the flow chart of FIG. 6, description of similar portions will not be repeated.

Referring to FIG. 10, time lapse is counted from the time point ($t_F$ of FIG. 5) when the printing on the first sheet is completed and the first heating device 2*a* is turned OFF. During this counting, whether the next print start signal is input or not is determined (S50 to S57 of FIG. 10). When the next print start signal is not input (NO in S57 of FIG. 10), process using the second heating device 2*b* is performed as in the flow chart of FIG. 6 (S58 to S60 of FIG. 10). Meanwhile, when the next print start signal is input (YES in S57 of FIG. 10), the second heating device 2*b* is not driven and the next printing is continuously performed (S53 to S57 of FIG. 10).

The prescribed time period in FIG. 10 is determined to be the time period necessary for the temperature of printing head 1 or the temperature $T_H$ of ink 3 in print head 1 to attain $T_H$ =50° C. after the first heating device 2*a* is turned OFF. Here, the temperature $T_H$ is not specifically limited to 50° C. It is preferably that the temperature is sufficiently lower than the heating temperature of the first heating device 2*a*, that is, sufficiently lower than T=155° C., for example, and high enough to make short the time period necessary for the ink 3 to attain T 155° C., for example, when the first heating device 2*a* is driven again. Therefore, when printing is continuously performed within the prescribed time period of FIG. 10, the time necessary for warming up the apparatus can be reduced as compared when the printing is performed for the first time.

In FIG. 10, whether or not the seconding printing is to be performed continuously is determined by counting time. However, it is essentially determined by whether the Temperature T of head 1 or of ink 3 in head 1 is at a prescribed temperature or lower. Therefore, the temperature of head 1 or the temperature of ink 3 in head 1 may be detected by using a temperature sensor such as a thermister, and whether heating operation using the second heating device 2*b* is to be performed or not, or whether next printing should be continued, may be determined.

Figure 11:
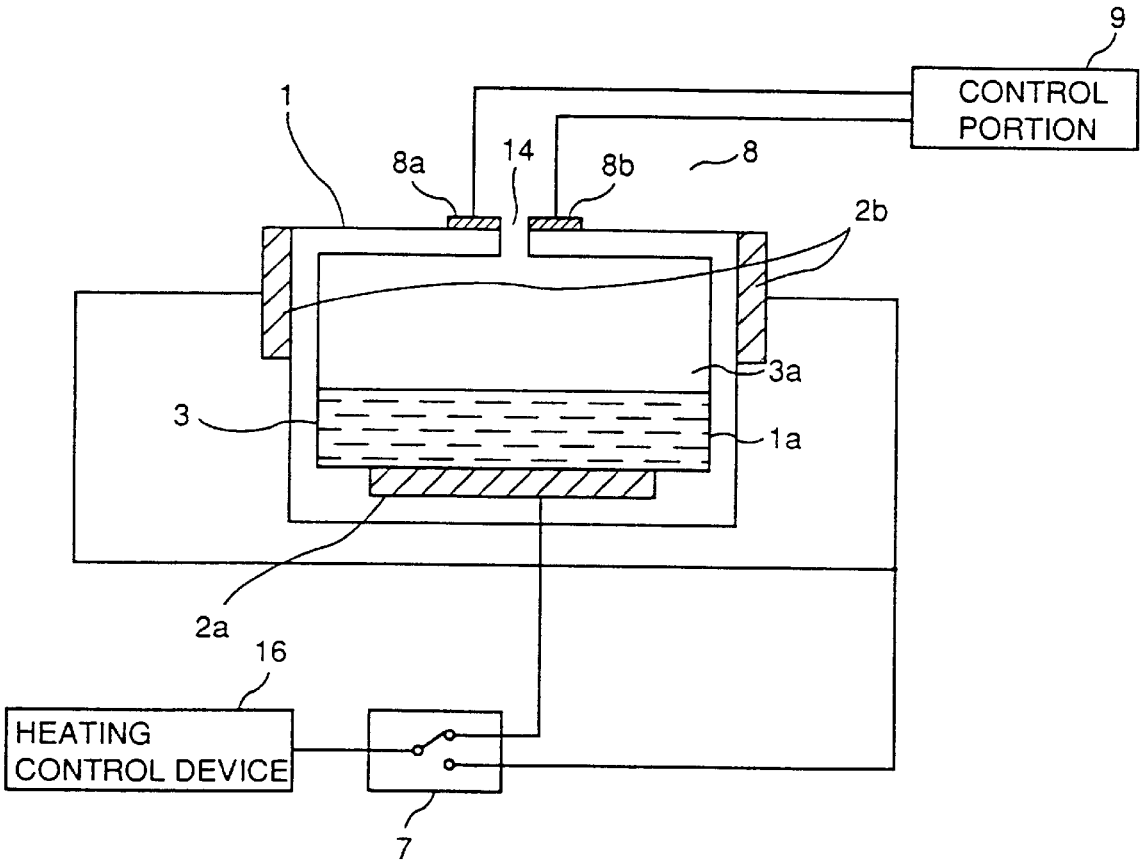
FIG. 11 shows a modification of a driving mechanism of a heating device in the image recording apparatus of FIG. 1.

FIG. 11 shows an example of modification of the driving mechanism for heating devices 2*a* and 2*b* in the image recording apparatus shown in FIG. 1. In the image recording apparatus of FIG. 1, heating devices (2*a*, 2*b*) and heating control devices (16*a*, 16*b*) controlling the same are in one to one correspondence. However, noting the fact that heating devices 2*a* and 2*b* are not simultaneously driven, heating devices 2*a* and 2*b* may be both driven by heating control device 16. The image recording apparatus of FIG. 11 will be described in the following. However, detailed description is not repeated, as the basic operation is the same as described with reference to FIG. 1.

The image recording apparatus of FIG. 11 includes, in place of heating control devices 16*a* and 16*b*, a heating control device 16 and a selector 7 for selectively driving heating devices 2*a* and 2*b*. Selector 7 is controlled by the CPU 20 shown in FIG. 4. The first and second heating devices 2*a* and 2*b* are connected through selector 7 to heating control device 16. Selector 7 has its connection switched in accordance with a control signal from CPU 20 such that a control signal from heating control device 16 is applied to heating device 2*a* or 2*b*. More specifically, when ink 3 should be heated at a constant temperature (for example T=155° C. when the evaporating temperature $t_g$ of ink 3 is 140° C., for example), selector 7 connects heating control device 16 to the first heating device 2*a*. When the inner wall surface of ink chamber 1*a* is to be heated at the melting temperature of ink 3, that is, $T_m$=110° C., for example, after the end of printing, the selector connects heating control device 16 to the second heating device 2*b*. By using selector 7 in this manner, the heating control device can be shared by the heating devices 2*a* and 2*b*, and therefore the structure of the image recording apparatus can be simplified.

Figure 12:
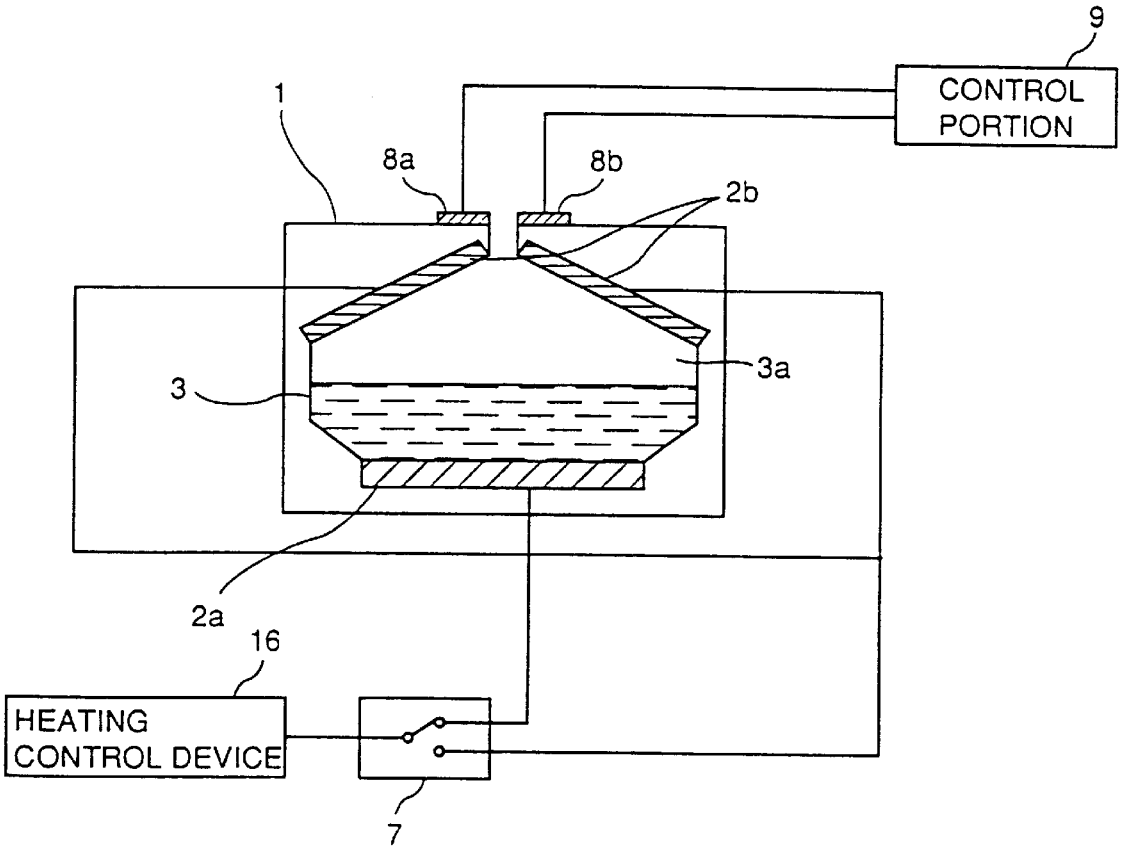
FIG. 12 shows another modification of the ink chamber of the image recording apparatus shown in FIG. 1.
Figure 13:
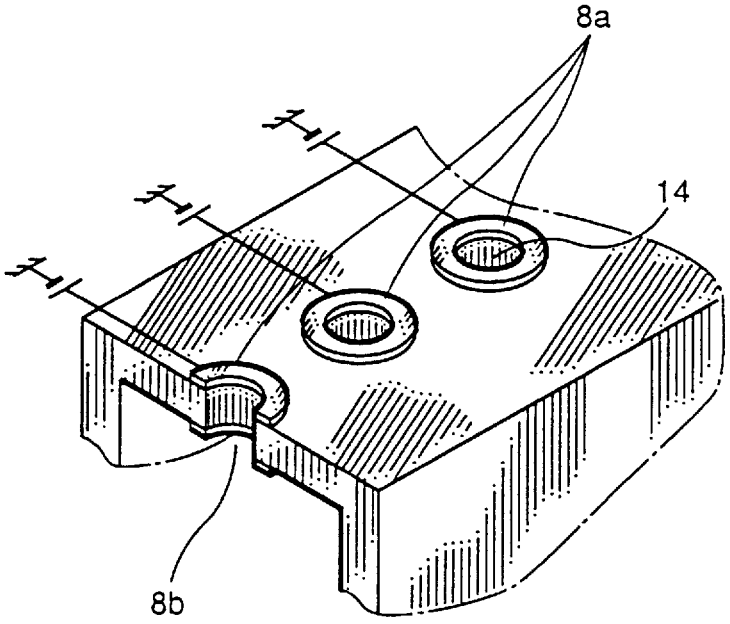
FIG. 13 is a perspective view showing a still further example of the structure of the emission opening shown in FIG. 1.
Figure 14:
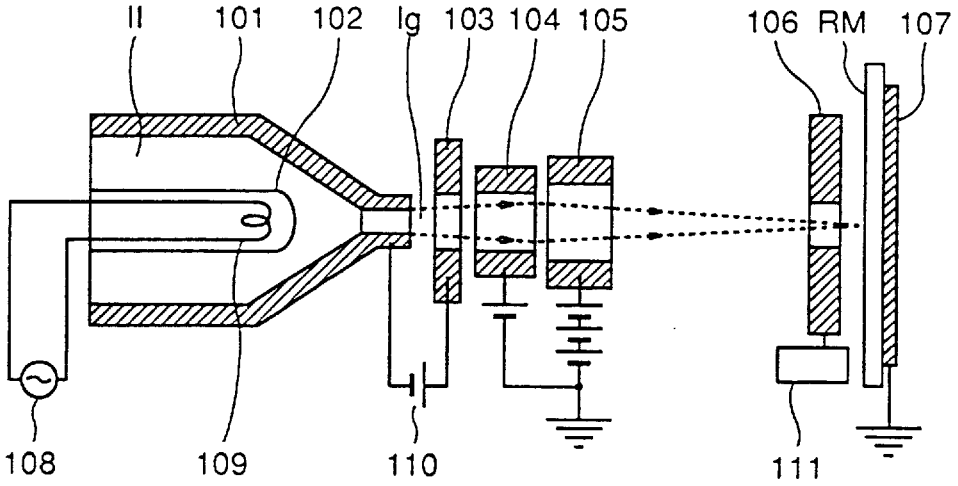
Fig. 14 PRIOR ART
FIG. 14 is a block diagram showing a structure of a conventional image recording apparatus.

FIG. 12 shows another modification of ink chamber la of the image recording apparatus shown in FIG. 11. FIG. 13 is a perspective view showing a still further example of the emission opening 14 shown in FIG. 1.

Referring to FIG. 13, electrostatic shutter 8 is formed as ring-shaped electrodes 8*a* and 8*b* above and below the emission opening 14. In this case, electric field acts parallel to the direction of emission of ink 3*a*. Therefore, as compared with the structure shown in FIGS. 2 and 3, the charged gaseous ink 3*a* can be confined within ink chamber 1*a* with smaller voltage.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An image recording apparatus for recording an image by emitting ink contained in advance in a reservoir portion to a recording medium, the reservoir portion having an inner wall, said image recording apparatus comprising:

first heating means for evaporating said ink by heating:

emitting means for emitting the ink evaporated by said first heating means from said reservoir portion to said recording medium;

control means for controlling said evaporated ink such that said evaporated ink is intermittently emitted through said emitting means in accordance with image data corresponding to said image; and second heating means for heating again and liquefying said ink solidified and adhered on the inner wall of said reservoir portion said ink having been evaporated by said first heating means and not emitted from said emitting means.

2. The image recording apparatus according to claim 1, further comprising heating control means for operating said second heating means before or after recording of said image.

3. The image recording apparatus according to claim 2, wherein when said image is to be recorded continuously over a plurality of said recording medium, said heating control means operates said second heating means before or after continuos recording.

4. The image recording apparatus according to claim 1, wherein heating temperature of said ink adhered on said inner wall by said second heating means is lower than evaporating temperature of said ink.

5. The image recording apparatus according to claim 1, further comprising emission control means for preventing said evaporated ink from being emitted from said reservoir portion while said second heating means is in operation.

6. The image recording apparatus according to claim 1, wherein time of operation of said second heating means for heating said ink adhered on said inner wall is determined in accordance with an amount of said ink adhered on said inner wall.

7. The image recording apparatus according to claim 1, wherein the inner wall of said reservoir portion has such a shape that facilitates recovery of said ink liquefied by heating by said second heating means back to said reservoir portion.

8. The image recording apparatus according to claim 1, wherein said second heating means liquefies said ink adhered on said inner wall of said reservoir portion after emission of said ink from said emitting means.

9. A method of image recording, for recording an image by emitting ink contained in advance in a reservoir portion onto a recording medium, comprising:

a first step (S2–S6) of intermittently emitting evaporated ink from said reservoir portion onto said recording medium in accordance with image data corresponding to said image; and a second step (S7, S10) of heating and liquefying said ink solidified and adhered by said recording on an inner wall of said reservoir portion.

10. The method of image recording according to claim 9, wherein said second step includes a third step (S7) of preventing emission of evaporated said ink from said reservoir portion, and a fourth step (S8) for heating and liquefying said ink solidified and adhered on the inner wall of said reservoir portion.

11. An image recording apparatus for recording an image by evaporating solid ink and emitting to a recording medium, comprising:

a recording head portion containing therein a reservoir portion having an inner wall, said reservoir portion including a first reservoir portion for accommodating said solid ink and a second reservoir portion for accommodating the evaporated ink;

first heating means provided at said recording head portion for heating and evaporating said solid ink;

charging means provided at said recording head portion for charging the evaporated ink in said second reservoir portion;

an emission hole provided at said recording head portion for emitting the ink charged by said charging means;

electric field forming means provided outside said recording head portion near said emitting hole, for controlling emission of said ink;

second heating means provided at said recording head portion, for heating again the ink evaporated by said heating means but not emitted from said emission hole and adhered on said inner wall of said first reservoir portion; and an electrode portion provided at a position opposing said emission hole outside said recording head portion, for guiding said charged ink toward said recording medium through said emission hole.

12. The image recording apparatus according to claim 11, wherein said second heating means provides a heating area extended near to said emission hole on said inner wall.

13. The image recording apparatus according to claim 11, wherein said emission hole is provided at an upper portion of said recording head portion, and said inner wall at the upper portion of said recording head portion is formed with an inclination.

14. The image recording apparatus according to claim 11, wherein said emission hole is formed as a plurality of slit holes, and said electric field forming means has a plurality of electrodes corresponding to said plurality of slit holes on one of opposing sides of said emission hole and has either a plurality of electrodes corresponding to said plurality of slit holes or one electrode shared by said plurality of slit holes on the other one of the opposing sides.

15. The image recording apparatus according to claim 11, wherein said second heating means heats said ink to a temperature not higher than evaporating temperature of the ink.

* * * * *